United States Patent [19]

Wagner

[11] 4,368,799

[45] Jan. 18, 1983

[54] STRAIGHT-THROUGH FLOW MUFFLER

[75] Inventor: Wayne M. Wagner, Apple Valley, Minn.

[73] Assignee: Donaldson Company, Inc., Minneapolis, Minn.

[21] Appl. No.: 197,506

[22] Filed: Oct. 16, 1980

[51] Int. Cl.[3] ..... F01N 1/02; F01N 1/08

[52] U.S. Cl. ..... 181/255; 181/272; 181/273

[58] Field of Search ..... 181/247, 250, 252, 255, 181/256, 269, 272, 273, 276, 266

[56] References Cited

U.S. PATENT DOCUMENTS

| | | | |
|---|---|---|---|
| 1,794,276 | 2/1931 | Bowes . | |
| 2,023,024 | 12/1935 | Kittell . | |
| 2,047,443 | 7/1936 | Starkweather et al. . | |
| 2,047,775 | 7/1936 | Gunn . | |
| 2,055,453 | 9/1936 | Horton . | |
| 2,233,327 | 2/1941 | Sauer . | |
| 2,528,674 | 11/1950 | Thomas . | |
| 2,548,563 | 4/1951 | Smith . | |
| 2,562,101 | 7/1951 | Hoyle . | |
| 2,940,538 | 6/1960 | Billey . | |
| 3,485,039 | 12/1969 | Wehinger . | |
| 3,672,464 | 6/1972 | Rowley et al. | 181/253 |
| 4,064,962 | 12/1977 | Hunt | 181/265 |
| 4,143,739 | 3/1979 | Nordlie | 181/272 |

FOREIGN PATENT DOCUMENTS

| | | | |
|---|---|---|---|
| 448877 | 8/1925 | Fed. Rep. of Germany . | |
| 1942084 | 2/1971 | Fed. Rep. of Germany | 181/252 |
| 323515 | 7/1957 | Switzerland | 181/272 |

*Primary Examiner*—George H. Miller, Jr.
*Assistant Examiner*—Thomas H. Tarcza
*Attorney, Agent, or Firm*—Merchant, Gould, Smith, Edell, Welter & Schmidt

[57] ABSTRACT

A straight-through flow muffler (10) is shown. A cylindrical housing (11) has an inlet **(13*a*), an outlet (14*a*), and a pair of axially aligned, longitudinally spaced tubes (15, 16) extending from the inlet and outlet into the center of the muffler housing. Imperforate baffles (17, 18) separate the muffler housing into a plurality of attenuation chambers (20, 21, 22) surrounding the tubes (15, 16). A pair of sonic chokes (25, 26) are mounted in series in the tubes. The baffles and a pattern of perforations in the tubes cooperate to block flow between chambers except through the sonic chokes (25, 26)** while permitting fluid communication between the tubes and the individual chambers.

10 Claims, 5 Drawing Figures

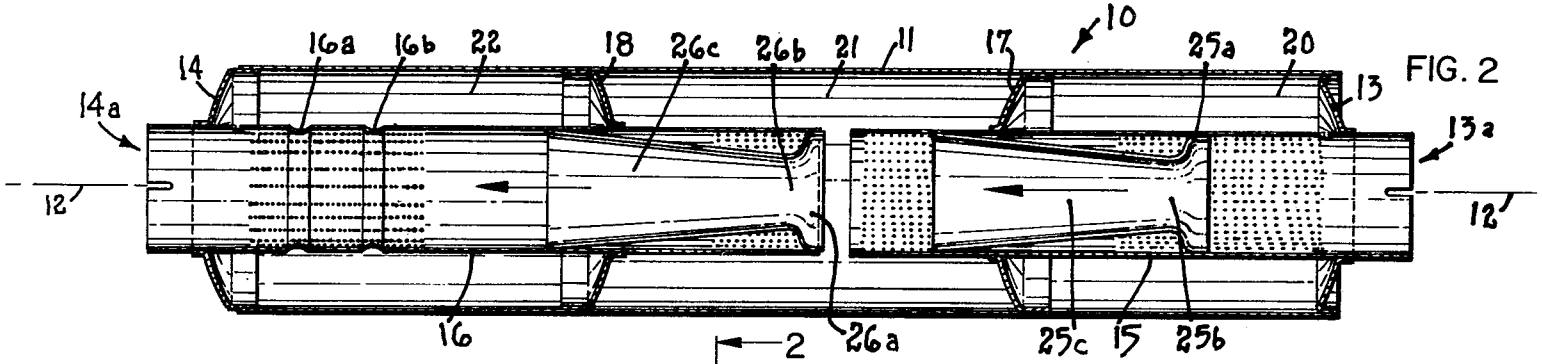
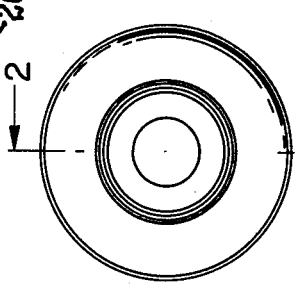
FIG. 1
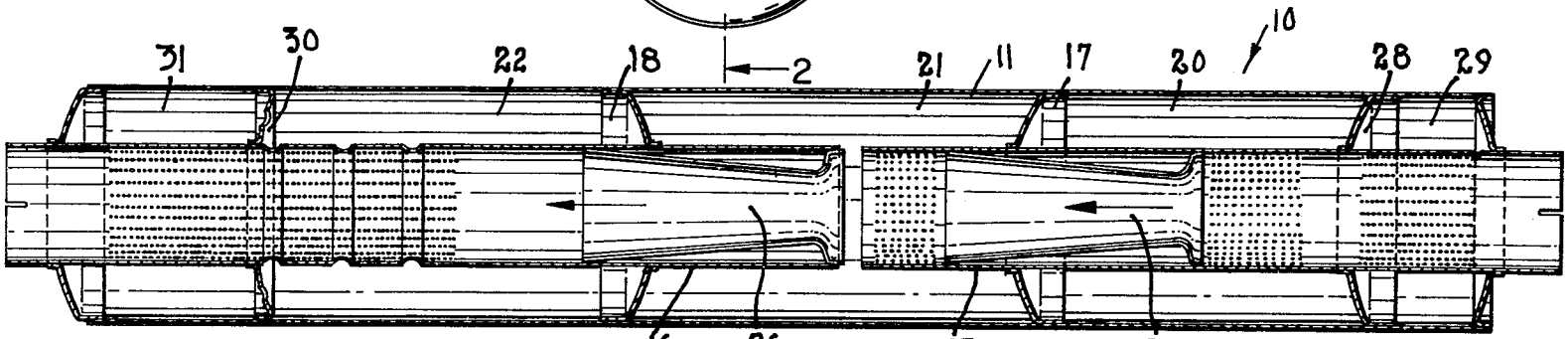
FIG. 3

STRAIGHT-THROUGH FLOW MUFFLER

TECHNICAL FIELD

The invention relates to mufflers for heavy-duty trucks and in particular relates to a straight-through flow muffler employing, in combination with three or more chambers, a pair of serially arranged sonic chokes to achieve improved exhaust noise silencing without significantly increasing exhaust system back pressure.

BACKGROUND OF THE INVENTION

The Clean Air Act of 1970 and the Noise Control Act of 1972, both as amended, together with the dramatically increased fuel costs of recent years, have combined to create the need for continually improving exhaust systems for heavy-duty trucks. The need for cleaner emissions is often at odds with the need for more silencing. The truck smoke and gaseous emission regulations, plus truck horsepower and fuel economy needs, have resulted in the use of diesel turbo-charged engines with significantly increased engine air demands, but no increase has been permitted in either intake restriction or exhaust system back pressure. One way of seeking to improve exhaust noise level is to utilize silencing features which increase back pressure but this option is not always desirable.

For 1982, manufacturers of heavy-duty diesel trucks will be required to limit truck noise to a sound level not to exceed 80 dBA at 50 feet. This is a drive-by test and all noise generated by the truck, including exhaust noise, is included in the measurement. Because exhaust noise is generally more easily controlled than engine mechanical or driveline noise, truck manufacturers will require mufflers which will silence exhaust noise down to the 65–68 dBA range, and at the same time will desire substantially less flow losses than current systems. This is about a 15 dBA improvement over 1973, a 10 dBA improvement over 1975 and a 5 dBA improvement over 1978.

The state of the art at the present time is represented by the structures shown in the Rowley et al. U.S. Pat. No. 3,672,464, issued June 27, 1972; the Hunt U.S. Pat. No. 4,064,962, issued Dec. 27, 1977; the Nordlie U.S. Pat. No. 4,143,739, issued Mar. 13, 1979; and variations of the three devices. The Rowley patent, which is assigned to the same company as the present invention, and which was released to production in 1970, utilizes a sonic choke and straight-through flow. Further, a flow path around the sonic choke is provided to lower the back pressure. In about 1971, a model was utilized in which all of the flow went through the sonic choke, which then utilized a larger diameter throat in the venturi. Some additional silencing was also achieved in later years by increasing the diameter of the muffler and, in some styles, increasing the length of the body. These sonic choke-type mufflers with straight-through flow met the silencing needs of the time and were very fuel efficient because of their low back pressure.

In about 1974, it became necessary once again to improve the silencing. The Rowley type muffler was again modified, this time by fully capping the inlet tube with a baffle so that all exhaust flow was diverted through a muffler chamber before entering the sonic choke. This substantially increased the back pressure, but it did achieve the necessary improvement in silencing. That muffler, with the capped inlet tube and the single sonic choke, still works very well on four-cycle engines. It will silence current four-cycle diesel engines to the 65 dBA level, but the back pressure is somewhat high.

A bigger problem, however, is the silencing of two-cycle diesel engines. The two-cycle engine operates in a different frequency spectrum. In addition, the two-cycle engine requires a positive displacement blower and utilizes an exhaust turbo charger. Thus, while certain state of the art mufflers can be used to silence four-cycle engines, mufflers of conventional size are normally not capable of silencing two-cycle engines to the necessary dBA level for 1982. Our limited tests appear to show that the Hunt-type mufflers can silence into the low 70's and that the Nordlie-type mufflers can silence into the high 60's on four-cycle engines and into the high 70's on two-cycle engines. The modified Rowley-type mufflers, utilizing a single sonic choke, can silence four-cycle engines into the mid 60's and two-cycle engines into the low 70's. Thus, utilizing present state of the art mufflers, the four-cycle engines can be silenced to the necessary level but at the cost of an undesirably high back pressure, but the two-cycle engines cannot be effectively silenced to the 65–68 dBA level.

To meet today's noise level requirements, truck mufflers are typically nine to ten inches in diameter and about 45 inches long. It was thought, prior to the present invention, that in order to provide the silencing required for 1982, it would be necessary to both make technical improvements and increase the muffler size, i.e. to increase the diameter to 12 inches or else increase the length to about 60 inches, while at the same time double wrapping the muffler to control shell noise and adding other noise reduction features such as packing. Even if these prospective changes to the existing structures had sufficiently reduced the noise level, however, they would have undesirably increased the size of the mufflers, made them more expensive to manufacture, and would probably have increased the back pressure.

In seeking to design a muffler which would adequately silence the two-cycle diesel engines for 1982, I tried many styles of mufflers and in particular, several which utilized a sonic choke. One variation employed the capped inlet tube, with the outlet offset to provide a double-S flow pattern. In other variations, specific chambers were tuned and the capped inlet tube was used with and without a sonic choke. None of these variations showed enough promise. Even those combinations which substantially increased the back pressure did not result in any substantial reduction in noise level. It was only after I made a substantial departure from the prior art that the necessary reduction in noise level was achieved. I discovered that a muffler having two sonic chokes in series, with the two sonic chokes arranged in combination with three chambers, resulted in substantial improvement in performance. In this design, all of the exhaust flows through the tube assembly carrying the sonic chokes and none of the flow is bypassed through the chambers, which helps control shell noise. The basic design, which can be varied by adding additional chambers, or by adding absorptive packing, provides a muffler which will effectively silence the two-cycle diesel engine down to the 65–68 dBA level, while at the same time keeping back pressure at an acceptable level. Tests have shown that the improved silencing can be achieved at about half the allowed back pressure. This reflects a substantial reduction in muffler pressure drop because about one-third of the allowable back pressure is generally the result of exhaust system piping loss. As compared to state of the art muffler designs as applied to two-cycle diesel truck engines, the present invention has provided almost a 10 dBA further reduction in noise level, which corresponds to a 90% reduction in sound energy, without increasing the size of the muffler. Mufflers according to the present invention can thus be used by truck manufacturers on both two-cycle and four-cycle engines to meet the 1982 noise requirements. Because of its simplicity, and because it can be so easily combined with other muffler components, the present invention may also provide a basis for further reductions in vehicle noise levels.

BRIEF DESCRIPTION OF THE DRAWINGS

FIG. 1 is an end view of a preferred embodiment of a muffler according to my invention;

FIG. 2 is an axial sectional view of the muffler, taken along line 2—2 of FIG. 1;

FIG. 3 is an axial sectional view of an alternate embodiment of my invention;

DETAILED DESCRIPTION OF THE INVENTION

Figure 4:
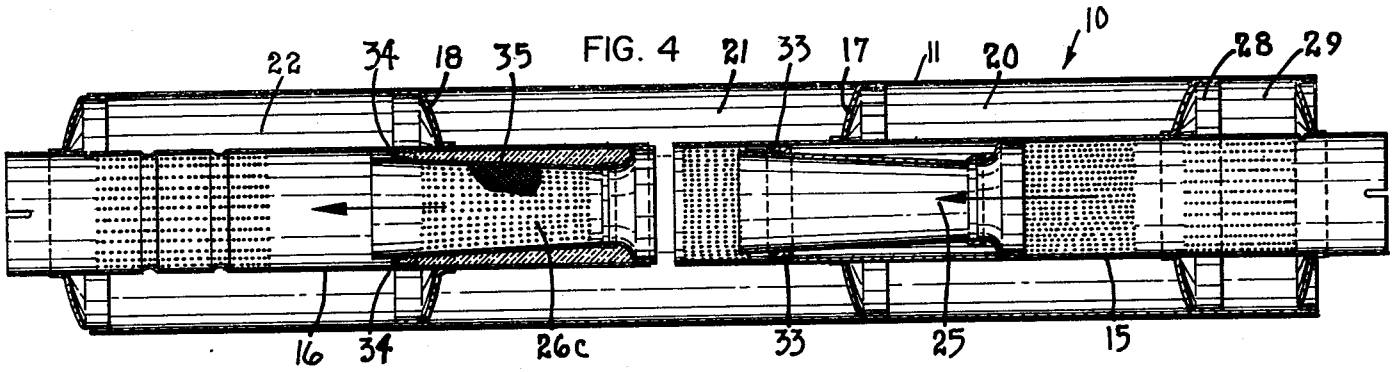
FIG. 4 is an axial sectional view of another alternate embodiment of my invention.

The drawings disclose several muffler embodiments intended for use with internal combustion engines and particularly for use with diesel engines for heavy-duty trucks. Referring to FIGS. 1 and 2, muffler 10 comprises an elongated cylindrical housing 11 formed about a longitudinal axis 12, having annular end caps 13 and 14 which respectively define coaxially aligned muffler inlet 13*a* and muffler outlet 14*a*. Although the housing 11 is preferably cylindrical, an oval design could also be utilized.

Tubular conduit means are arranged between the inlet 13*a* and outlet 14*a* including a first tube 15 extending through the inlet 13*a* to a point near the center of the housing 11, which is axially aligned with and longitudinally spaced from a second tube 16 extending through the outlet 14*a* and terminating near the center of the housing 11. For a typical application, the body 11 of the muffler shown in FIG. 2 would be approximately 45 inches long and 10 inches in diameter, and the tubes 15 and 16 would be five inches in diameter. Because FIG. 2 is drawn generally to scale, the respective sizes of the other elements of the invention can be seen from the drawing.

Tube 15 is supported near its inlet end by welding it or otherwise attaching it to the opening in end cap 13, and is supported within housing 11 by an imperforate annular baffle 17 which extends between the tube and the housing. Second tube 16 is supported at its outlet end within the opening in end cap 14 and is supported within the housing 11 by an annular, imperforate baffle 18 which extends between the tube and the housing. Baffles 17 and 18 each have an exterior cylindrical flange which engages the interior wall of housing 11, and a central opening with a short cylindrical flange which engages the respective tube 15 or 16. The baffles preferably are welded to the respective tubes.

The housing 11, end caps 13 and 14, and the spaced baffles 17 and 18 define three attenuation chambers including a first chamber 20 adjacent inlet 13*a*, a second or central chamber 21 between baffles 17 and 18, and a third chamber 22 near outlet 14*a*. The three chambers thus surround the tubular conduit means, and the gap between the tubes 15 and 16 is located within the central chamber 21. It is preferred that the tubular conduit means comprise a pair of spaced tubes 15 and 16 in order to accommodate manufacturing tolerances and assembly procedures, and to provide for thermal expansion and contraction.

Mounted within first tube 15 adjacent baffle 17 is a first member or sonic choke 25, and mounted within second tube 16 adjacent baffle 18 is a second nozzle member or sonic choke 26. The two nozzle members each have a mouth 25*a*, 26*a* facing toward inlet 13*a* which engages the inner surface of the respective tube, a portion at the mouth converging to a throat 25*b*, 26*b* of restricted diameter, and an elongated portion 25*c*, 26*c* which diverges from the throat to an outlet which engages the inner surface of the respective tube. The sonic chokes 25 and 26 are imperforate and are serially arranged within the tubular conduit means to provide a straightthrough flow path for the exhaust gases. In this embodiment, the two sonic chokes 25, 26 are each of a two piece construction, divided along line 2—2 of FIG. 1, with the adjoining edges being provided with narrow flanges which engage each other and which can be spot welded to assemble the sonic choke.

The mouth or inlet 25*a* of sonic choke 25 is located within the boundaries of first chamber 20 while its outlet is located within the boundaries of second chamber 21. As shown on the drawing, a portion of tube 15 which extends through chamber 20 is perforated so that chamber 20 acts as a resonator or attenuation chamber. It can further be seen that the portion of tube 15 surrounding sonic choke 25 in chamber 21 is imperforate thus combining with the baffle 17 to block fluid communication between chambers 20 and 21 except through sonic choke 25. It is noted that a portion of tube 15 surrounding sonic choke 25 is also perforated so that the annular space therebetween is added to the volume of chamber 20. These perforations behind sonic choke 25 can be removed if desired to modify the silencing characteristics of the muffler.

Sonic choke 26 is located with its mouth or inlet 26*a* positioned at the end of tube 16 within chamber 21, and its outlet extends through baffle 18 into chamber 22. A portion of tube 16 located within chamber 21 surrounding sonic choke 26 is perforated to add to the volume of that chamber while that portion of tube 16 adjacent sonic choke 26 in chamber 22 is imperforate so that it cooperates with baffle 18 to prevent fluid communication between chambers 21 and 22 except through sonic choke 26. It is noted that the portion of tube 15 which extends beyond sonic choke 25 into chamber 21 is also perforated so that chamber 21 cooperates with the tubular conduit means to act as a resonator or attenuation chamber.

A portion of the tube 16 within chamber 22 is also perforated so that chamber 22 can also act as a resonator or attenuation chamber. The metal of tube 16 within chamber 22 is deformed to provide a pair of spaced, annular, inwardly protruding beads 16*a*, 16*b* within the perforated area. The beads 16*a*, 16*b* act to reduce or eliminate regenerative whistle which can be generated in mufflers of this nature under certain conditions. This is covered by U.S. Pat. No. 4,023,645 assigned to the same company as the present invention.

The pattern of perforations of tubes 15 and 16 is such that fluid communication is provided between the tubular conduit means and the three chambers while at the same time flow between the chambers is blocked except through the nozzle members 25, 26. Exhaust gases entering inlet 13*a* are forced through sonic choke 25 and then through sonic choke 26 because no bypass routes are available. The throat portions 25*b*, 26*b* create an acoustical impedance which causes a portion of the sound waves attempting to enter the nozzle members to be reflected back. Noise cancellation then occurs because of the reflected back sound waves and because of the action of the attenuation chambers. Low back pressure is achieved because the exhaust gases pass straight through the muffler and because the diverging portions 25*c*, 26*c* of the sonic chokes act to regain the pressure lost in the throat areas.

Figure 5:
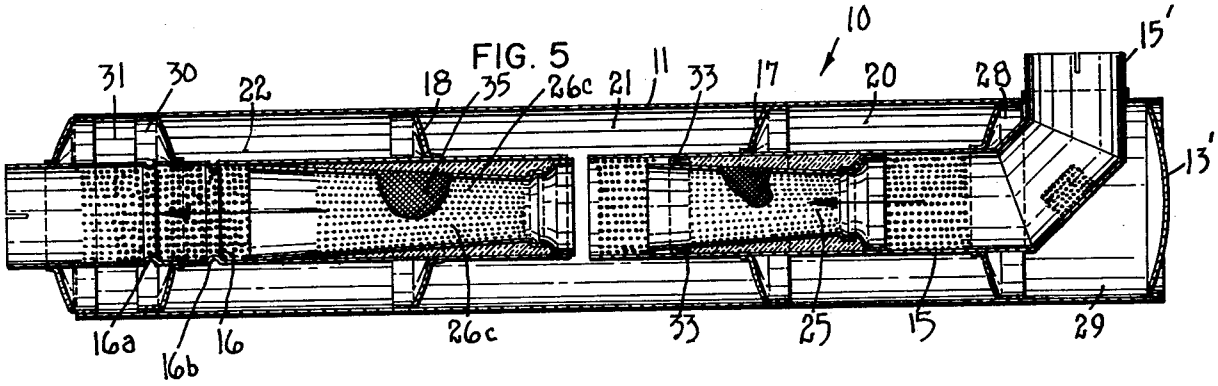
FIG. 5 is an axial sectional view of another alternate embodiment drawn to a different scale as compared to the other views, showing a side inlet version.

The muffler construction of FIGS. 1 and 2 tends to be highly reactive within a relatively narrow frequency range. Thus, in some applications, where the noise being generated varies through a wider range, it is desirable to add additional features to the invention so that it more effectively cancels noise over the wider frequency range. The embodiments of FIGS. 3, 4, and 5 are configured to provide the additional silencing needed for some applications. In FIG. 3, the configuration of chambers 20, 21 and 22 and their relationship to the sonic chokes 25 and 26 are basically as shown in FIG. 2. One difference is that the portions of the tubes 15 and 16 behind the sonic chokes is imperforate so that the annular spaces around the imperforate sonic chokes are not utilized. In this embodiment, an additional imperforate baffle 28 is provided between inlet 13*a* and baffle 17 to define an additional attenuation chamber 29. The portion of tube 15 extending through chamber 29 is perforated as shown.

An additional perforated baffle 30 is positioned between outlet 14*a* and baffle 18 to define another attenuation chamber 31. Again, the portion of tube 16 within chamber 31 is perforated. The perforations in baffle 30 permit slight flow between chamber 22 and chamber 31 which controls regenerated noise of the outlet perforations.

The embodiment of FIG. 4 is similar to that of FIG. 1 except that the additional chamber 29 has been added at the inlet end. The sonic chokes 25 and 26 are also of a two-piece construction connected at the throat area and the outlet ends of the sonic chokes are smaller in diameter than the tubes 15, 16 so that spacer rings 33, 34 are provided to center the outlet ends of the sonic chokes and to block the flow of fluid between the sonic choke outlet end and the tube. This embodiment also differs in that sonic choke 26 is perforated throughout the diverging section 26*c* and the annular space between sonic choke 26 and tube 16 is packed with an absorptive material such as fiberglass. Surrounding the perforated sonic choke 26 is a woven fiberglass cloth 34 which prevents the fiberglass from being eroded away. It is noted that although the cone portion 26*c* is perforated, that portion of tube 16 surrounding the sonic choke is imperforate so that sound waves do not pass from chamber 21 through the packing material into the sonic choke 26. This construction and arrangement of the second sonic choke 26 acts to absorb or cancel out some of the high-frequency noise not theretofore cancelled, and effectively increases the frequency range over which the muffler will successfully operate.

The embodiment of FIG. 5 is similar to the others insofar as the relationship of the sonic chokes and chambers is concerned, and like the embodiment of FIG. 3, it has the additional inlet chamber 29 and the additional outlet chamber 31. In this embodiment, one of the whistle beads 16*a* is located in chamber 31 and the other within chamber 21. Both of the sonic chokes 25, 26 are also perforated and the annular spaces behind them are packed with an absorptive material. Again, the respective tubes 15 and 16 behind the sonic chokes are not perforated. This arrangement, with both of the sonic chokes being perforated and backed by a sound absorbent material, can be used where silencing over a broader frequency range is desired or where particular silencing problems exist. Another feature of this muffler which is different from the others is that a side inlet 15' is provided through the side wall of chamber 29 at right angles to the axis of the muffler housing. A transistion section is provided between the inlet portion 15' and the main body portion of tube 15 so that exhaust flow is again directed straight through the muffler as in the other embodiments. This side inlet version may be used to eliminate the elbow in the exhaust system which is otherwise required on truck exhaust systems where the muffler is vertically positioned, thus increasing the muffler length without raising the overall height of the outlet end.

For a typical muffler application utilizing a five inch diameter tube, the sonic chokes 25, 26 may vary from 10 inches to 20 inches long, and the throat diameter will typically vary between fifty to seventy-five percent of the tube diameter. These dimensions are related as illustrative rather than limiting. Further, in the same muffler, the two sonic choke assemblies can be of different lengths and throat diameters, and acoustic packing can be used in one, neither or both of the sonic choke assemblies. The acoustic tuning associated with the muffler can also be changed by changing the distance between sonic chokes, the number and size of the perforations, and changing the sizes of the three chambers. The perforation pattern can also be changed to modify the chamber volumes and noise cancellation characteristics. As noted with respect to FIGS. 3 and 4, one or more additional chambers can be added at the ends of the muffler. In all cases, however, the flow is straight through the unit and no flow is permitted to bypass either of the sonic chokes. The result is a muffler that will silence even two-cycle diesel engines for heavy-duty trucks down to the 65–68 dBA level while at the same time keeping back pressure at an unusually low level, when sonic choke throat diameters are properly sized.

What is claimed is:

1. A muffler, comprising:

(a) a housing defining a longitudinal chamber having an inlet and an outlet;

(b) means including tubular conduit means between said inlet and outlet providing an exhaust flow path through said muffler;

(c) a pair of nozzle members, each having a mouth, a portion converging to a throat, and a portion diverging from the throat to an outlet;

(d) means mounting said pair of nozzle members in series in said tubular conduit means;

(e) means including a pair of spaced, imperforate baffles positioned adjacent said pair of nozzle members to define a plurality of attenuation chambers along said conduit means; and (f) resonator means including a pattern of perforations in said tubular conduit means providing communication between said conduit means and each attenuation chamber.

2. A muffler according to claim 1 wherein said housing and pair of baffles define three attenuation chambers which act as resonators including a first chamber near said inlet, a second, center chamber, and a third chamber near said outlet, wherein a first nozzle member has its mouth in communication with said first chamber and its outlet in communication with said second chamber, and wherein a second nozzle member has its mouth in communication with said second chamber and its outlet in communication with said third chamber.

3. A muffler according to claim 2 wherein said tubular conduit means comprises first and second axially aligned, longitudinally spaced tubes extending from said inlet and outlet respectively, into said second chamber; said nozzle members being mounted in said tubes.

4. A muffler according to claim 3 wherein said first tube is perforated around said first nozzle member in said first chamber but imperforate around said first nozzle member in said second chamber, wherein said second tube is perforated around said second nozzle member in said second chamber but imperforate around said second nozzle member in said third chamber, and wherein said tubes and nozzle members are so constructed and arranged as to prevent exhaust flow between said tubes and said mouths and outlets of said nozzle members.

5. A muffler according to claim 3 wherein the portions of said tubes surrounding said nozzle members are imperforate.

6. A straight-through flow muffler, comprising:

(a) a housing having an inlet and an outlet;

(b) first and second sonic chokes each having an inlet and an outlet;

(c) means mounting said sonic chokes in series in said housing to provide an exhaust flow path straight through said housing;

(d) means including baffle means defining a first attenuation chamber surrounding said first sonic choke inlet, a second attenuation chamber surrounding said first sonic choke outlet and second sonic choke inlet, and a third attenuation chamber surrounding said second sonic choke outlet, said means mounting said sonic chokes including tubular conduit means comprising first and second axially aligned, spaced tubes extending from said inlet and outlet respectively, into said second chamber; and (e) means including perforations in said conduit means providing fluid communication between the exhaust flow path and each attenuation chamber, so that said chambers act as resonators, said baffle means blocking flow between said chambers except through said sonic chokes.

7. A muffler according to claim 6 wherein the portion of said tubular conduit means surrounding at least one of said sonic chokes is perforated so that the annular space between the sonic choke and perforated conduit means is effectively added to the volume of the surrounding chamber.

8. A muffler for two cycle diesel engines, comprising:

(a) a housing having an inlet and an outlet;

(b) first and second axially aligned, spaced tubes extending from said inlet and outlet respectively, into said housing;

(c) a first sonic choke in said first tube and a second sonic choke in said second tube, each having an inlet and an outlet;

(d) a first imperforate baffle mounted between said first tube and said housing to define an attenuation chamber surrounding said first sonic choke inlet;

(e) a second imperforate baffle mounted between said second tube and said housing to define an attenuation chamber surrounding said second sonic choke outlet, said first and second baffle members further defining an additional attenuation chamber surrounding said first sonic choke outlet and second sonic choke inlet, whereby flow is blocked between said chambers except through said sonic chokes; and (f) means for acoustically tuning said chambers so that said chambers act as resonators including a pattern of perforations in said tubes and the space between said tubes providing communication between said tubes and said attenuation chambers.

9. A muffler according to claims 6 or 8 wherein said sonic chokes each comprises a nozzle member having a mouth, a portion converging to a throat, and a portion diverging from the throat to an outlet.

10. A muffler according to claim 8 wherein a portion of at least one of said tubes surrounding a sonic choke is perforated, and wherein the tube, sonic choke and corresponding baffle are so constructed and arranged as to prevent exhaust flow around said sonic choke.

* * * * *